US012673814B1

(12) United States Patent
Cook et al.

(10) Patent No.: US 12,673,814 B1
(45) Date of Patent: Jul. 7, 2026

(54) METHODS OF PACKAGING AND ASSEMBLING OUTDOOR GRILLS, AND RELATED COMPACTLY PACKAGED OUTDOOR GRILLS

(71) Applicant: Traeger Pellet Grills, LLC, Salt Lake City, UT (US)

(72) Inventors: Samuel Cook, Salt Lake City, UT (US); Christian Whilhelm S. Mirasol, Nanshan (CN); Max Hegewald, Salt Lake City, UT (US); James Wang, Sijing Town (CN)

(73) Assignee: Traeger Pellet Grills, LLC, Salt Lake City, UT (US)

( * ) Notice: Subject to any disclaimer, the term of this patent is extended or adjusted under 35 U.S.C. 154(b) by 0 days.

(21) Appl. No.: 19/012,649

(22) Filed: Jan. 7, 2025

(51) Int. Cl.
*B65D 85/68* (2006.01)

(52) U.S. Cl.
CPC ..... *B65D 85/68* (2013.01); *B65D 2585/682* (2013.01)

(58) Field of Classification Search
CPC B65D 85/68; B65D 2585/682; B65D 88/025; B65D 85/62; B65D 2585/647; B65D 85/64; F24B 1/18
USPC ..... 206/315.11, 320, 207, 576, 499, 326; 126/501, 19.5
See application file for complete search history.

(56) References Cited

U.S. PATENT DOCUMENTS

| | | | | |
|---|---|---|---|---|
| 5,050,731 | A * | 9/1991 | Baynes | B65D 81/07 206/592 |
| 8,297,271 | B2 * | 10/2012 | Cedar | H10N 10/13 126/501 |
| 8,387,609 | B2 * | 3/2013 | Olsen | A47J 37/0704 126/41 R |
| 11,033,147 | B2 * | 6/2021 | O'Shaughnessy | A47J 37/0786 |
| 11,708,975 | B2 * | 7/2023 | Colston | A47J 37/0786 126/10 |
| 11,725,825 | B2 * | 8/2023 | Pruitt | F24B 13/04 126/501 |
| 12,385,644 | B2 * | 8/2025 | Colston | F24B 13/006 |
| 2017/0203904 | A1 * | 7/2017 | Cibert | B65D 81/113 |
| 2019/0125129 | A1 * | 5/2019 | Bittel | A47J 37/0713 |
| 2022/0000311 | A1 * | 1/2022 | Ebersold | A47J 37/0763 |
| 2025/0113946 | A1 * | 4/2025 | Rose | F24C 1/16 |

FOREIGN PATENT DOCUMENTS

CN 113840561 * 12/2021

* cited by examiner

*Primary Examiner* — Rafael A Ortiz
(74) *Attorney, Agent, or Firm* — TraskBritt

(57) ABSTRACT

A packaged, unassembled wood-pellet grill device comprises a package container, a lid of the grill device disposed within the package container, and a hollow grill body of the grill device nested within the lid. The hollow grill body of the grill device has interior surfaces partially defining an interior grilling cavity of the grill device. The packaged, unassembled wood-pellet grill device further comprises a hollow wood pellet hopper of the grill device nested within the interior grilling cavity defined by interior surfaces of the hollow grill body of the grill device. A method is used to package a wood-pellet grill device.

20 Claims, 4 Drawing Sheets

METHODS OF PACKAGING AND ASSEMBLING OUTDOOR GRILLS, AND RELATED COMPACTLY PACKAGED OUTDOOR GRILLS

TECHNICAL FIELD

This disclosure relates generally to methods of packaging outdoor grill devices and related compactly packaged grill devices.

BACKGROUND

Outdoor grills have long been used to prepare food and perform other tasks. For example, outdoor grills are often used to prepare meats, vegetables, fruits, and other types of food. Outdoor grills are typically packaged and sold as partially assembled. The packaging of outdoor grills is typically bulky, thereby taking up a considerable volume in the shipping container during shipping and transportation, as well as demanding a rather large storage space in a warehouse or a retail store.

Accordingly, there is a need for the method of packaging an outdoor grill that could result in a more compactly packaged outdoor grill.

BRIEF SUMMARY

Some embodiments include a packaged, unassembled wood-pellet grill device. The packaged, unassembled wood-pellet grill device may include a package container. A lid of the grill device is disposed within the package container, and a hollow main body of the grill device is nested within the lid. The hollow main body of the grill device has interior surfaces partially defining an interior grilling cavity of the grill device. The packaged, unassembled wood-pellet grill device may further include a hollow wood pellet hopper of the grill device nested within the interior grilling cavity defined by the interior surfaces of hollow main body of the grill device.

Additional embodiments include a method of packaging a wood-pellet grill device. The method may include disposing a lid of the grill device within a package container, and nesting a hollow main body of the grill device within the lid. The hollow main body of the grill device has interior surfaces partially defining an interior grilling cavity of the grill device. The method may further include nesting a hollow wood pellet hopper of the grill device within the interior grilling cavity defined by the interior surfaces of hollow main body of the grill device.

BRIEF DESCRIPTION OF THE DRAWINGS

For a detailed understanding of the disclosure, reference should be made to the following detailed description, taken in conjunction with the accompanying drawings, in which like elements have generally been designated with like numerals, and wherein.

DETAILED DESCRIPTION

Figure 1:
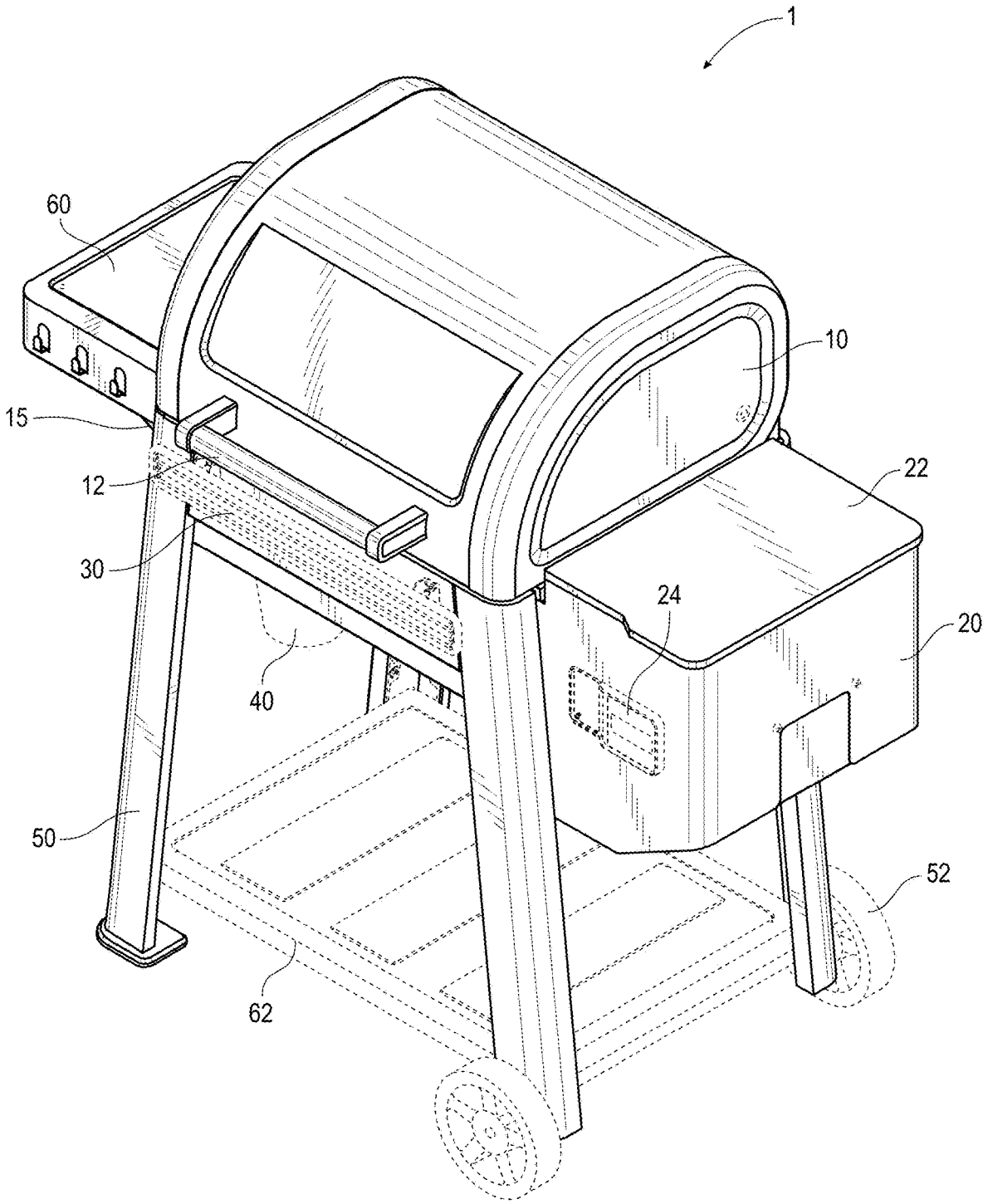
FIG. 1 is a perspective view of a grill device and components thereof that may be packaged for shipment and assembly in accordance with embodiments of the present disclosure.

The illustrations presented herein are not actual views of any grill, wood-pellet grill, or any component thereof, but are merely idealized representations, which are employed to describe embodiments of the disclosure.

As used herein, the singular forms following "a," "an," and "the" are intended to include the plural forms as well, unless the context clearly indicates otherwise.

As used herein, "and/or" includes any and all combinations of one or more of the associated listed items.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," "above," "beneath," "side," "upward," "downward," etc., is used for clarity and convenience in understanding the disclosure and accompanying drawings, and does not connote or depend on any specific preference or order, except where the context clearly indicates otherwise. For example, these terms may refer to an orientation of components of a grill device when utilized in a conventional manner. Furthermore, these terms may refer to an orientation of components of a grill device as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, the term "grill device" means a grilling and/or smoking device used to grill and/or smoke food. Particularly, the grill devices described herein may be outdoor grill devices configured for grilling and/or smoking food in outdoor environments.

FIG. 1 is a perspective view of a grill device 1 and components thereof that may be packaged in accordance with one or more embodiments of the present disclosure. As shown in FIG. 1, the grill device 1 may include a grill lid 10, a lid handle 12 attached to the grill lid 10, a hollow grill body 15, a hopper body 20 for containing fuel (e.g., wood pellets), a hopper lid 22, a controller 24, one or more accessory rails 30, a grease container 40, grill legs 50 and wheels 52 (or castors), a side shelf 60, and a bottom shelf 62. The controller 24 may control a cooking temperature of the grill device 1, control fuel feed rates, control cooking cycles and processes, control fuel burn rates, monitor ambient temperature, monitor internal and external temperatures, monitor fuel levels, monitor grease and ash levels, monitor flame presence and levels, control ignition processes, and/or perform other functions.

Figure 2:
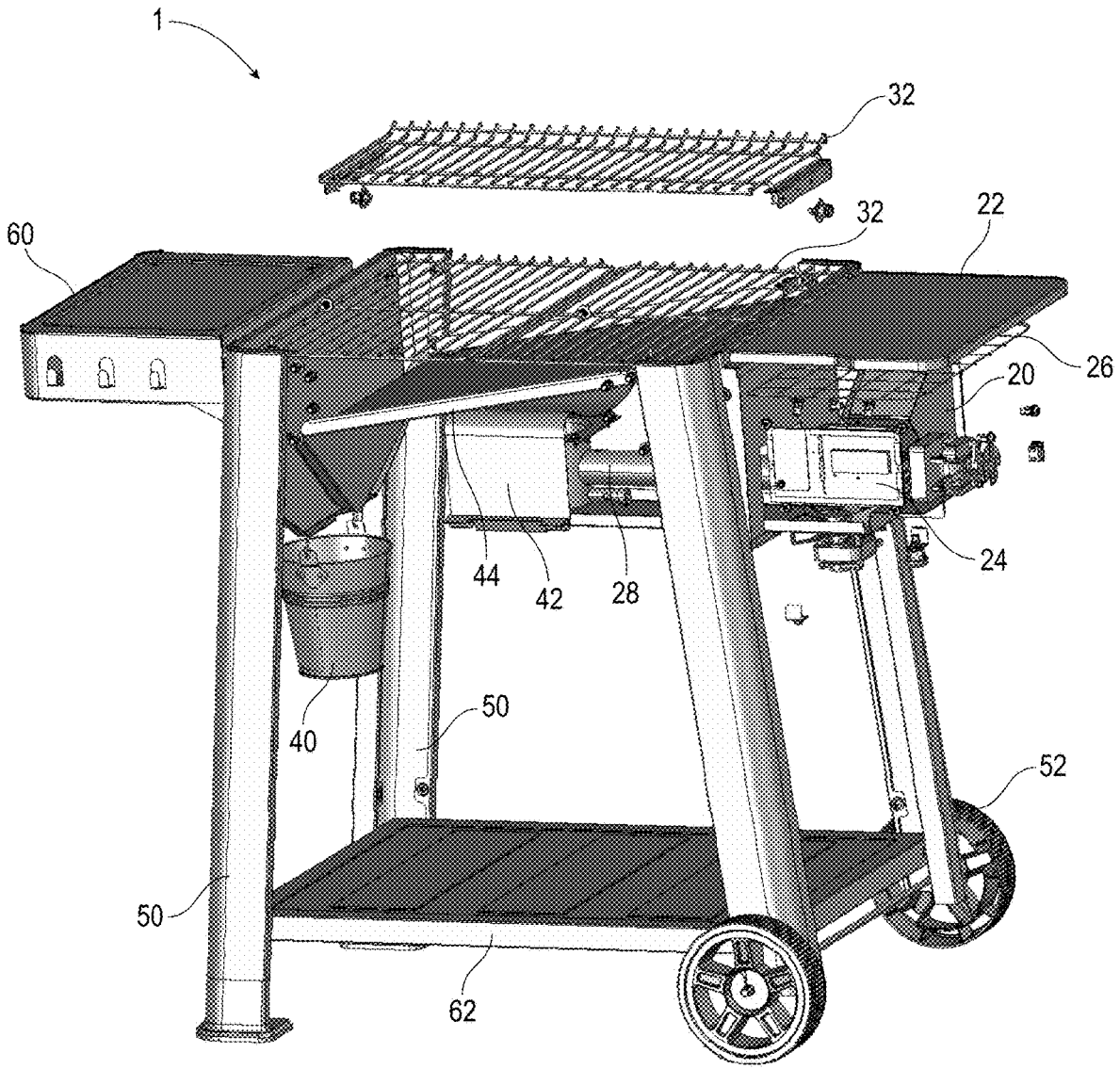
FIG. 2 is partial perspective view of the grill device in FIG. 1 with a grill lid, a grill body, and a hopper body hidden to reveal various other interior components of the grill device.

FIG. 2 is an additional perspective view of the grill device 1 with the grill lid, the hollow grill body, and the hopper body hidden to show various other interior components of the grill device. As shown in FIG. 2, the grill device 1 may further include one or more grill grates 32, a safety grate 26 within an interior of the hopper body 20, an auger assembly 28 extending between the hopper body 20 and a fire pot 42 assembly, and a drip tray 44 proximate the grease container 40. The auger assembly 28 may be a modular auger assembly 28 including an auger housing, auger, motor for driving rotation of the auger, bearing assemblies, etc., so as to enable and facilitate later assembly of the modular auger assembly with the other components of the grill device 1 by an end user without specialized skills or tools.

In some embodiments, the grill device 1 may include a wood-pellet grill. For example, the grill device 1 may utilize wood pellets that are fed from the hopper body 20 to the fire pot assembly 42 in which they are burned to produce heat and smoke for cooking and preparing food products.

Figure 3:
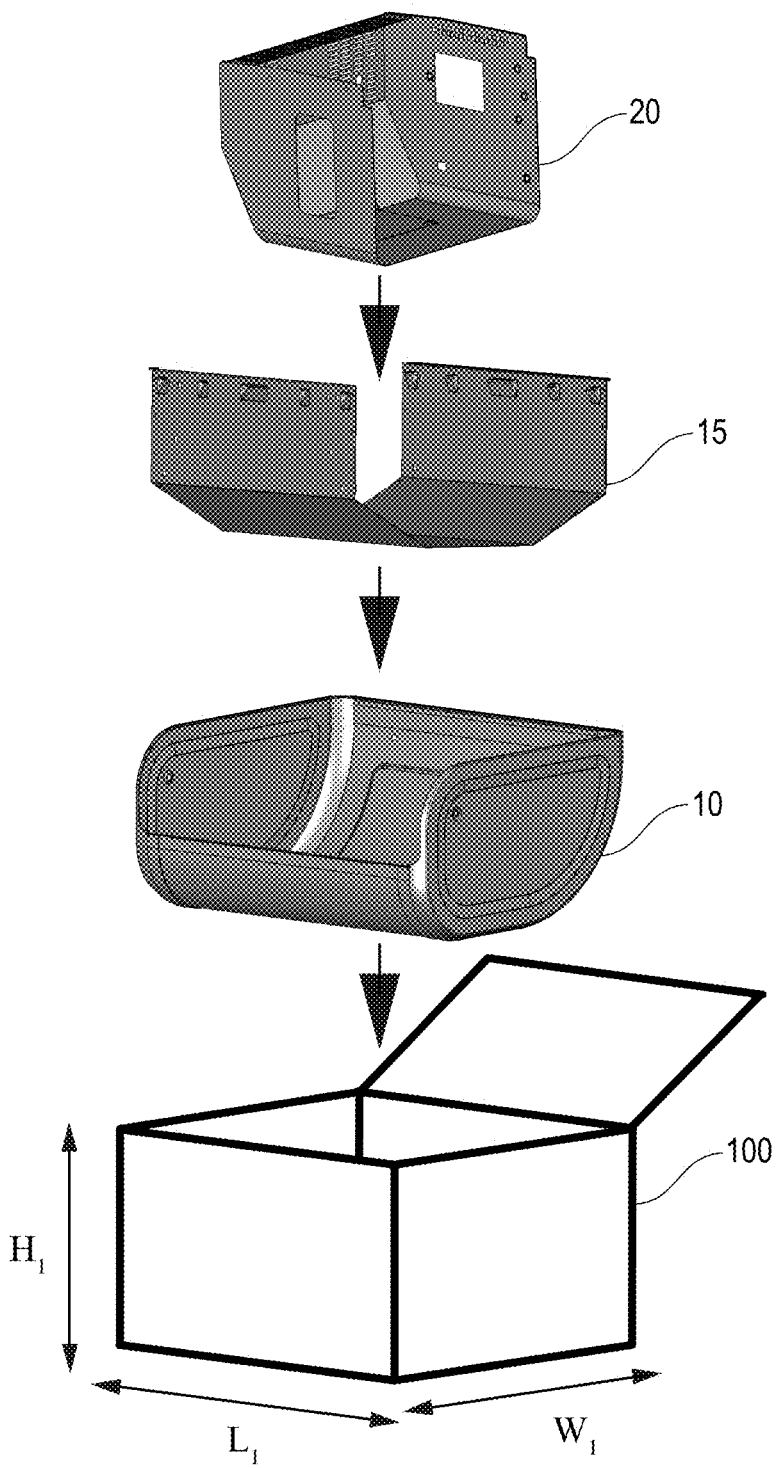
FIG. 3 is an exploded view of a packaged, unassembled wood-pellet grill device, in accordance with embodiments of the present disclosure, and also schematically illustrates a method of packaging a grill device in accordance with one or more additional embodiments of the present disclosure.

FIG. 3 is an exploded view of a packaged, unassembled wood-pellet grill device in accordance with embodiments of the present disclosure, and also schematically illustrates a method of packaging a grill device in accordance with one or more embodiments of the present disclosure.

The method may include disposing a grill lid 10 within a package container 100, and nesting a hollow grill body 15 of the grill device 1 within the grill lid 10. The hollow grill body 15 of the grill device 1 has interior surfaces partially defining an interior grilling cavity of the grill device. The method may also include nesting a hollow hopper body 20 within the interior grilling cavity defined by the interior surfaces of hollow grill body 15 of the grill device 1.

In some embodiments, the method further includes disposing a plurality of legs 50 of the grill device 1 within the interior grilling cavity defined by the interior surfaces of hollow grill body 15 of the grill device 1. In some embodiments, the method further includes disposing a plurality of legs 50 of the grill device 1 within the package container 100 and near the grill lid 10.

In some embodiments, the method further includes disposing one or more grill grates 32 within the interior grilling cavity defined by the interior surfaces of hollow grill body 15 of the grill device 1. In some embodiments, the method further includes disposing one or more grill grates 32 within the package container 100 and adjacent to the grill lid 10.

In some embodiments, the method further includes disposing a controller 24 within the interior grilling cavity defined by the interior surfaces of hollow grill body 15 of the grill device 1. In some embodiments, the method further includes disposing a controller 24 within the package container 100 and over the grill lid 10.

In some embodiments, the method further includes disposing an auger assembly 28 within the interior grilling cavity defined by the interior surfaces of hollow grill body 15 of the grill device 1.

In some embodiments, the method further includes disposing one or more of a heat baffle tray, a grease container, castors, trays, or an accessory rail within the interior grilling cavity defined by the interior surfaces of hollow grill body 15 of the grill device 1.

Accordingly, in one or more embodiments of the disclosure, a packaged grill device includes a package container 100, a grill lid 10 disposed within the package container 100, and a hollow grill body 15 of the grill device 1 nested within the grill lid 10. The hollow grill body 15 of the grill device 1 having interior surfaces partially defining an interior grilling cavity of the grill device 1. The packaged grill device also includes a hopper body 20 (e.g., a hollow wood pellet hopper) of the grill device 1 nested within the interior grilling cavity defined by the interior surfaces of hollow grill body 15 of the grill device 1.

In some embodiments, the packaged, unassembled grill device further includes a plurality of legs 50 of the grill device 1 disposed within the interior grilling cavity defined by the interior surfaces of hollow grill body 15 of the grill device 1. In some embodiments, the packaged, unassembled grill device further includes a plurality of legs 50 of the grill device 1 disposed within the package container 100 and near the grill lid 10.

In some embodiments, the packaged, unassembled grill device further includes a one or more grill grates 32 disposed within the interior grilling cavity defined by the interior surfaces of hollow grill body 15 of the grill device 1. In some embodiments, the packaged, unassembled grill device further includes one or more grill grates 32 disposed within the package container 100 and adjacent to the grill lid 10.

In some embodiments, the packaged, unassembled grill device further includes a controller 24 disposed within the interior grilling cavity defined by the interior surfaces of hollow grill body 15 of the grill device 1. In some embodiments, the packaged, unassembled grill device further includes a controller 24 disposed within the package container 100 and over the grill lid 10.

In some embodiments, the packaged, unassembled grill device further includes one or more of a heat baffle tray, a grease container, castors, trays, or an accessory rail within the interior grilling cavity defined by the interior surfaces of hollow grill body 15 of the grill device 1.

As shown in FIG. 3, the package container 100 may be a box. The package container 100 may have a first cuboid shape with a maximum length of $L_1$, a maximum width of $W_1$, and a maximum height of Hi defining a first volume of the package.

Figure 4:
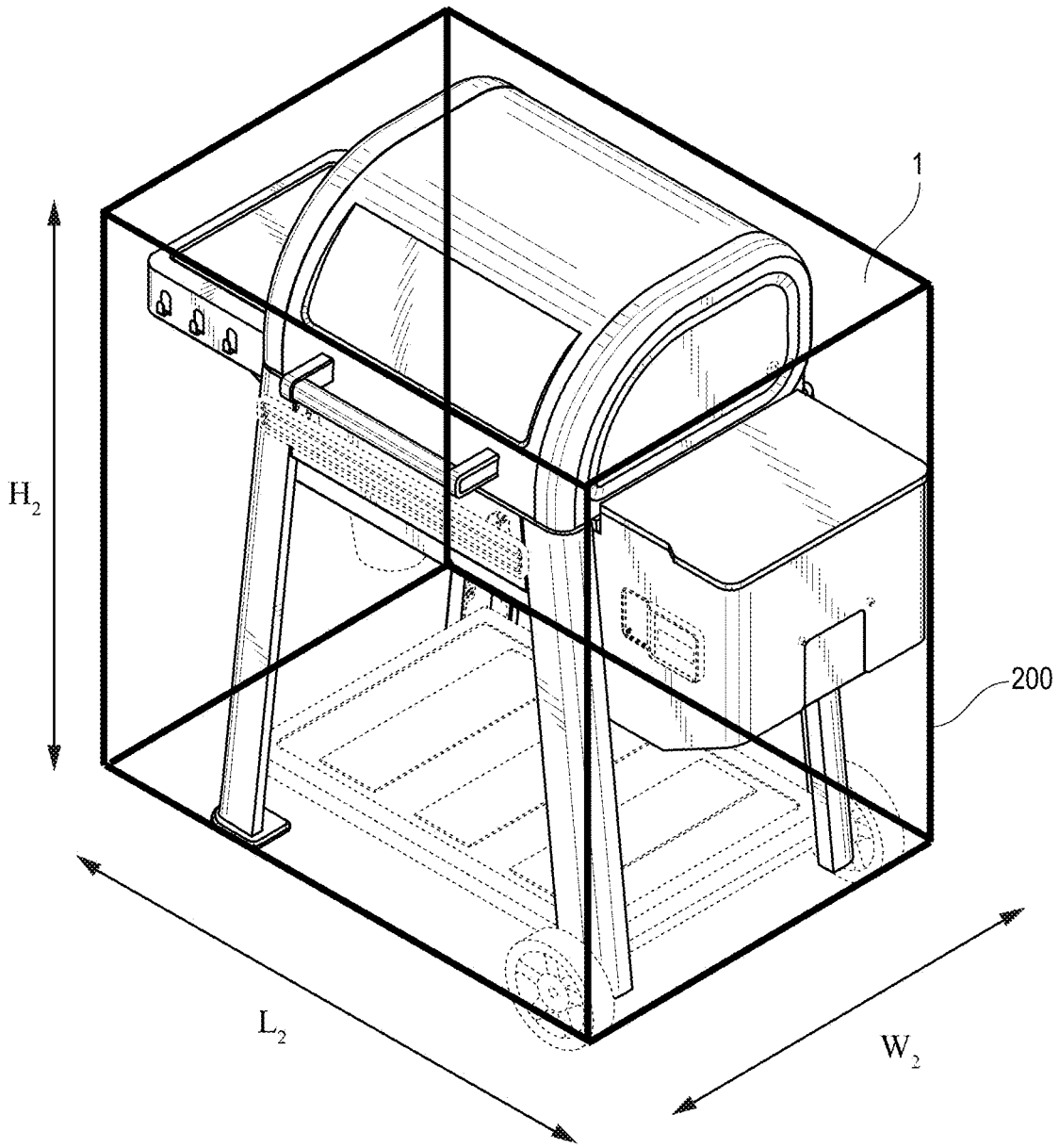
FIG. 4 is a perspective view of a fully assembled grill device like that shown in FIG. 1 but illustrating an imaginary cuboid defined by a maximum length, width, and height of the fully assembled grill device.

FIG. 4 is a perspective view of the grill device 1 after being removed from the package container 100 and fully assembled. The fully assembled grill device 1 has a maximum length of $L_2$, a maximum width of $W_1$, and a second maximum height of Hi defining an imaginary second cuboid shape 200 having a second volume. The second volume of the fully assembled grill device 1 is significantly larger than the first volume of the packaged, unassembled grill device 1.

In some embodiments, the volume of the packaged, unassembled grill device is 67% or less compared to the volume of the fully assembled grill device.

In some embodiments, the volume of the packaged, unassembled grill device is 65% or less compared to the volume of the fully assembled grill device.

In some embodiments, the volume of the packaged, unassembled grill device is 60% or less compared to the volume of the fully assembled grill device.

In some embodiments, the volume of the packaged, unassembled grill device is 55% or less compared to the volume of the fully assembled grill device.

In some embodiments, the volume of the packaged, unassembled grill device is 50% or less compared to the volume of the fully assembled grill device.

Therefore, the disclosed method of packaging a grill device significantly reduces the volume of a packaged, unassembled grill device. In some embodiments, the disclosed method provides a packaged, unassembled grill device with a volume that is 67% or less of the fully assembled grill device.

The disclosed packaged, unassembled grill device is more compact and less bulky than any conventional packaged, unassembled grill device. Thus, the disclosed packaged, unassembled grill device takes up considerably less volume in the shipping container during shipping and transportation, as well as demanding a significantly less storage space in a warehouse or a retail store, compared to the conventional packaged, unassembled grill device.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A packaged, unassembled wood-pellet grill device, comprising:

a package container;

a lid of the grill device disposed within the package container;

a hollow grill body of the grill device nested within the lid, the hollow grill body of the grill device having interior surfaces partially defining an interior grilling cavity of the grill device; and a hollow wood pellet hopper of the grill device nested within the interior grilling cavity defined by interior surfaces of the hollow grill body of the grill device.

2. The packaged, unassembled wood-pellet grill device of claim 1, further comprising a plurality of legs of the grill device disposed within the interior grilling cavity defined by the interior surfaces of the hollow grill body of the grill device.

3. The packaged, unassembled wood-pellet grill device of claim 1, further comprising one or more grill grates disposed within the interior grilling cavity defined by the interior surfaces of the hollow grill body of the grill device.

4. The packaged, unassembled wood-pellet grill device of claim 1, further comprising an electronic controller disposed within the interior grilling cavity defined by the interior surfaces of the hollow grill body of the grill device.

5. The packaged, unassembled wood-pellet grill device of claim 1, further comprising an auger mechanism disposed within the interior grilling cavity defined by the interior surfaces of the hollow grill body of the grill device.

6. The packaged, unassembled wood-pellet grill device of claim 1, further comprising one or more of a heat baffle tray, a grease container, castors, trays, or an accessory rail disposed within the interior grilling cavity defined by the interior surfaces of the hollow grill body of the grill device.

7. The packaged, unassembled wood-pellet grill device of claim 1, wherein the package container is a box having a first cuboid shape having a first maximum length, a first maximum width, and a first maximum height defining a first volume of the package.

8. The packaged, unassembled wood-pellet grill device of claim 7, wherein the grill, when removed from the package container and fully assembled, has a second maximum length, a second maximum width, and a second maximum height defining an imaginary second cuboid shape having a second volume, and wherein the first volume is 67% or less of the second volume.

9. The packaged, unassembled wood-pellet grill device of claim 8, wherein the first volume is 65% or less of the second volume.

10. The packaged, unassembled wood-pellet grill device of claim 9, wherein the first volume is 60% or less of the second volume.

11. The packaged, unassembled wood-pellet grill device of claim 10, wherein the first volume is 55% or less of the second volume.

12. The packaged, unassembled wood-pellet grill device of claim 11, wherein the first volume is 50% or less of the second volume.

13. A method of packaging a wood-pellet grill device, comprising:

disposing a lid of the grill device within a package container;

nesting a hollow grill body of the grill device within the lid, the hollow grill body of the grill device having interior surfaces partially defining an interior grilling cavity of the grill device; and nesting a hollow wood pellet hopper of the grill device within the interior grilling cavity defined by interior surfaces of the hollow grill body of the grill device.

14. The method of claim 13, further comprising disposing a plurality of legs of the grill device within the interior grilling cavity defined by the interior surfaces of the hollow grill body of the grill device.

15. The method of claim 13, further comprising disposing one or more grill grates within the interior grilling cavity defined by the interior surfaces of the hollow grill body of the grill device.

16. The method of claim 13, further comprising disposing an electronic controller within the interior grilling cavity defined by the interior surfaces of the hollow grill body of the grill device.

17. The method of claim 13, further comprising disposing an auger mechanism disposed within the interior grilling cavity defined by the interior surfaces of the hollow grill body of the grill device.

18. The method of claim 13, further comprising disposing one or more of a heat baffle tray, a grease container, castors, trays, or an accessory rail within the interior grilling cavity defined by the interior surfaces of the hollow grill body of the grill device.

19. The method of claim 13, further comprising selecting the package container to be a box having a first cuboid shape having a first maximum length, a first maximum width, and a first maximum height defining a first volume of the package.

20. The method of claim 19, wherein the grill, when removed from the package container and fully assembled, has a second maximum length, a second maximum width, and a second maximum height defining an imaginary second cuboid shape having a second volume, and wherein the first volume is 67% or less of the second volume.

* * * * *